US005910368A

United States Patent [19]

Ehret

[11] Patent Number: 5,910,368

[45] Date of Patent: Jun. 8, 1999

[54] NONWOVEN HYDROPHILIC BASED ON POLYLACTIDES

[75] Inventor: Philippe Ehret, Fortschwihr, France

[73] Assignee: Fiberweb France SA, Biesheim, France

[21] Appl. No.: 08/725,770

[22] Filed: Oct. 4, 1996

[30] Foreign Application Priority Data

Oct. 6, 1995 [FR] France ..... 95 11957

[51] Int. Cl.[6] ..... B32B 9/04; C08G 63/08

[52] U.S. Cl. ..... 428/411.1; 442/118; 442/119; 442/164; 528/354

[58] Field of Search ..... 442/118, 119, 442/164; 428/411.1; 528/354

[56] References Cited

U.S. PATENT DOCUMENTS 5,437,918 8/1995 Taniguchi et al. ..... 428/224

5,525,706 6/1996 Gruber et al. ..... 528/354

*Primary Examiner*—P. Hampton-Hightower

*Attorney, Agent, or Firm*—Weiser and Associates, P.C.

[57] ABSTRACT

The invention relates to a nonwoven based on thermoplastic filaments, wherein all the filaments of which it is composed are completely manufactured from a polymer or from a blend of polymers derived from lactic acid, said nonwoven being permanently hydrophilic.

The filaments of which the nonwoven according to the invention is composed are continuous filaments.

They may furthermore be subjected to a hydrophilic treatment using a surface-active agent.

19 Claims, 1 Drawing Sheet

NONWOVEN HYDROPHILIC BASED ON POLYLACTIDES

Figure 1:
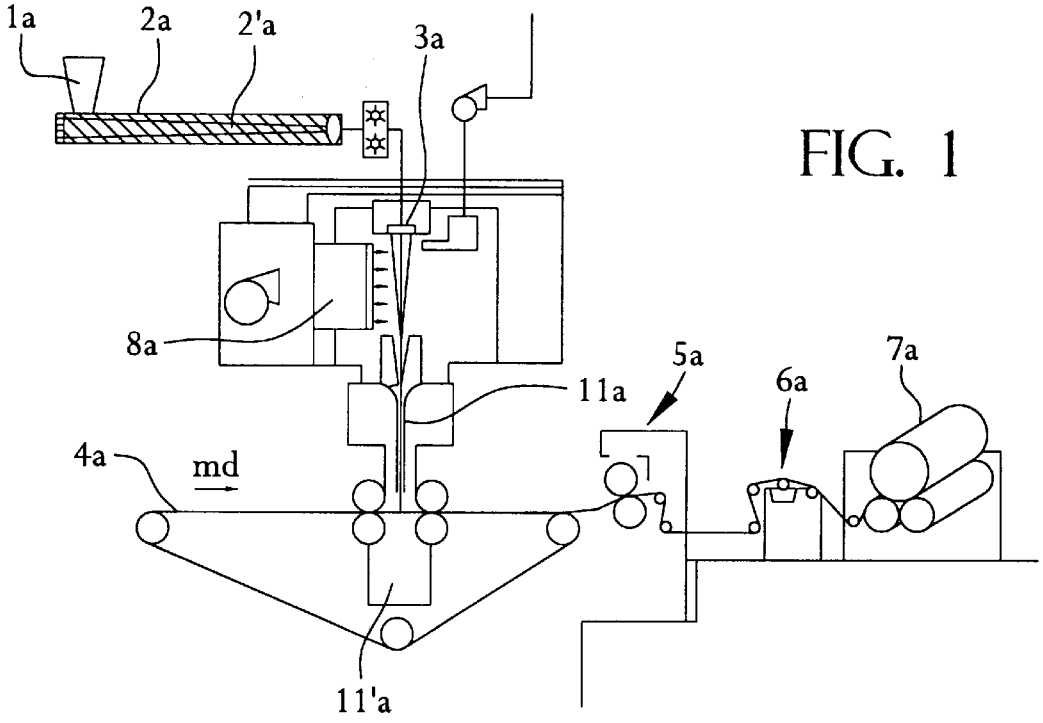

The invention relates to a hydrophilic nonwoven and to processes for obtaining it.

More particularly, this invention relates to the production of a polylactide-based nonwoven having hydrophilic properties enabling it to be used in articles of body hygiene (i.e. diapers), in the medical field (i.e. drapes), in the agricultural field (mulching) and other conventional applications of hydrophilic nonwovens.

Currently, throughout the world, the sites for dumping solid waste are rapidly filling up. This waste derives from, inter alia, products used only once, such as films and nonwovens for hygiene purposes (diapers and sanitary napkins), for the medical field (surgical gowns and drapes) and for the agricultural field (frost protection and mulching).

The use of degradable polymers, more specifically biodegradable polymers, such as polymers, based on lactic acids (abbreviated to PLA), constitutes one solution to these problems.

Currently, the polymers mentioned (especially PLAs) are well known in the medical field. They have been used as raw material for sutures, for various types of implants (screws, rods, plates and tubes) and for various controlled-diffusion systems.

PLA is one of the most promising materials for replacing the stable polymers in the composition of consumable products. PLA makes it possible to obtain mechanical and physico-chemical properties which are comparable to those of conventional polymers.

In addition to their biodegradability, polymers based on PLA make use of renewable resources, such as beet sugar, corn and whey. For this reason, the production of these polymers does not disturb the world's carbon dioxide balance (greenhouse effect). Composting or incineration of PLA releases the same quantity of carbon dioxide as that generated during its production. The incineration of polyolefin waste is relatively expensive because it generates too much heat and requires cooling using other materials mixed with the waste. In contrast, PLA contains 60% less energy than polypropylene or polyethylene, which allows better control of the temperature during incineration.

Finally, the production of PLA-based polymer uses renewable resources.

Some applications require a nonwoven to be obtained which has a hydrophilic nature. However, PLA-based nonwovens, like PP-based nonwovens, are naturally hydrophobic. The hydrophilic nature may be obtained by surface treatment of the nonwoven or by injecting into the extruder products conventionally used for polypropylene-based nonwovens.

The surface treatment of PLA-based nonwovens has caused the Applicant a problem since it is performed by using aqueous solutions either by lick-up or by spraying, or by application of foam. However, this treatment involves a certain critical moisture level during and after the treatment (the degradation is induced by hydrolysis) which must be controlled before packaging the nonwoven and despatching it.

The invention relates to the production of polylactide-based biodegradable nonwovens which are permanently hydrophilic.

Advantageously, it is rendered hydrophilic by treatment using a commercially available surface-active agent and it degrades more rapidly than an untreated nonwoven.

Figure 2:
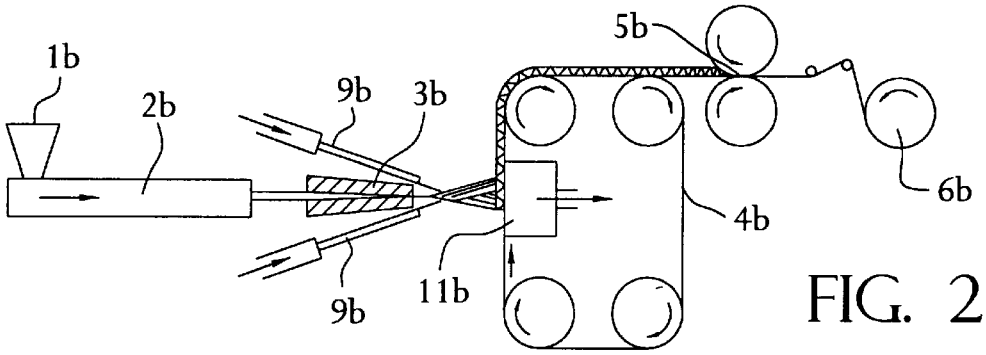
Figure 3:
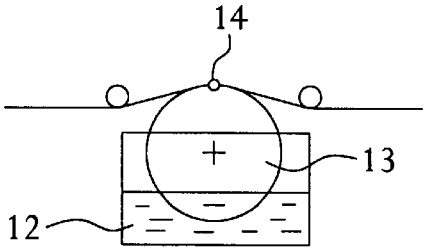
Figure 4:
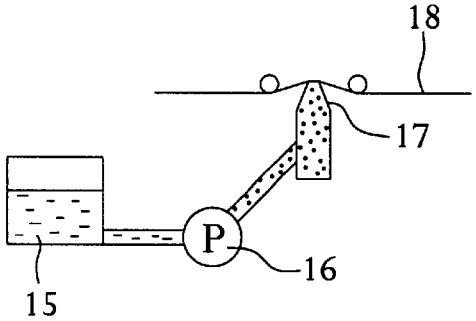

The invention will be better understood with the aid of the description which follows, given with reference to the following appended figures:

FIG. 1: a diagram of an installation employing spin bonding for the manufacture of a nonwoven according to the invention;

FIG. 2: a diagram of an installation employing a melt-blown process for the manufacture of a nonwoven according to the invention;

FIG. 3: a diagram of an installation for the hydrophilic treatment of the nonwoven according to the invention by lick-up;

FIG. 4: a diagram of an installation for the hydrophilic treatment of the nonwoven according to the invention by depositing a foam.

The raw material used in the invention comprises polymers based on PLA, including poly(L-lactic acid) (PLLA) or poly(D-lactic acid) (PDLA), or poly(DL-lactic acid) copolymers with a DL ratio varying from 0% to 100%, or blends of the polymers mentioned.

These PLA-based polymers forming this raw material may furthermore contain from 0.1% to 15% of plasticizer and/or from 0.1% to 5% of monomers and/or from 0.001% to 5% of various types of stabilizers, pigments, etc.

In this invention, the nonwoven consists of continuous fibers or filaments, preferably having a diameter between 0.1 and 100 $\mu$m.

This nonwoven may be obtained by various processes, for example by the two spun-bond processes (Lurgi and S-tex) or the melt-blown process, these being described hereinbelow. If a hydrophilic treatment is added to it, this may be carried out by lick-up, or by spraying, or by application of a foam, or by injecting surface-active agents into the extruder.

Spun-bond process

The diagram in FIG. 1 shows a representation of the spun-bond (i.e. S-tex) process, which includes a hopper (1*a*) for raw material, an extruder (2*a*), a screw (2'*a*), a spinneret (3*a*), a belt (4*a*), a calender (5*a*), a system (6*a*) for guiding the web and for adjusting the wind-up tension, a wind-up assembly (7*a*), a system (8*a*) for cooling the fibers, a drawing slit (11*a*) and a suction unit (11'*a*) for the drawing step.

In this process, the polymer is melted, extruded by means of a single-screw or twin-screw (2, 2*a*) extruder at a temperature preferably lying between 140 and 280° C., and conveyed to a spinning pump before passing through a filter to a spinneret having holes varying from 0.2 to 2.0 mm, preferably from 0.4 to 1.0 mm. The polymer is spun through the spinneret (3*a*) and passes on to the cooling (8) and drawing (11) installation. Cooling may be performed by means of chilled air, at a temperature preferably varying between 0 and 40° C. and a rate varying from 0.1 to 5 m/s, and the drawing may be performed by suction of air or blown air through the drawing system. The drawing system may have one slit (11) or may consist of a series of tubes or slits. The speed of the drawing air preferably lies between 10 and 400 m/s. In the drawing system, the fibers obtained have a decreasing diameter and an oriented structure. The draw ratio is generally from 1.1× to 20×, preferably from 2× to 15×. In the SB ply, the linear density of the fibers is preferably between 0.5 and 20 dtex, more particularly from 1 to 10 dtex.

The spinning system is followed by a system which lays the fibers down randomly on the belt. The belt conveys the web of fibers to a calender (5) heated to a temperature preferably varying from 40 to 160° C., more particularly from 60 to 110° C. Another slit may be installed before the calender so as to obtain a structured nonwoven composed of several similar or different plies.

The basis weight may be adjusted by varying the speed. This is generally between 5 and 200 g/m$^2$, depending on the application.

Melt-blown process

The diagram in FIG. 2 represents the MB process: a raw-material hopper (1*b*), an extruder (2*b*), a spinneret (3*b*), a forming belt (4*b*), a calender (5*b*), a winder (6*b*), a blowing unit (9*b*) and a suction unit (11*b*).

The MB process includes an extruder intended to melt the polymer. The extrusion temperatures preferably lie between 150° C. and 280° C. The polymer is conveyed from the extruder to the spinneret. The spinneret has only a single row of holes. The holes have a diameter of 0.2 to 2 mm.

An airflow on both sides of the row of holes projects the polymer in the form of fibers onto the travelling web. The basis weight of the MB web is adjusted depending on the speed of the belt and preferably lies between 5 and 100 g/m$^2$. The diameter of the fibers normally lies between 0.1 and 20 $\mu$m, preferably between 0.5 and 10 $\mu$m.

Hydrophilic treatment

The hydrophilic treatment is carried out by using surface-active agents such as silicone-polyether copolymers (i.e. Silwet® 12037 or Nuwet® 500 from OSI Specialities, 4 Place des Etats-Unis, Silic 220, 94518 Rungis Cedex). Various processes may be used. In the lick-up process, the surfactant is dissolved in water to a concentration of 1 to 50%, preferably 5 to 25%. The solution is brought to the nonwoven manufacturing installation according to the diagram in FIG. 3, showing a container for the solution (12), a smooth rotary roller (13), on which a thin film of surfactant is deposited, and a point (14) where the surfactant is deposited on the surface of the nonwoven.

The surfactant may be deposited on the web in the form of a foam. After stabilization, the foam has a lower viscosity than the previously employed solution and the quantity of surfactant is lower than in the solution. It is therefore easier to meter it accurately.

FIG. 4 describes the diagram of the installation for applying a foam: a container for the solution (15), a pump (16) forming the foam, a nozzle (17) for spraying the foam and the nonwoven (18).

It is sometimes necessary to combine a special foaming agent with the solution used in the foam treatment process. The amount of foaming agent is normally between 0.1% and 5%. The use and metered amount of foaming additive depend on the surfactant.

Another process for treating the web with a surfactant is spraying, the solution being sprayed onto the surface of the web using compressed air.

Finally, the last process consists in injecting the surface-active agent directly into the main extruder, or in incorporating a masterbatch (PLA and surfactant) in the main extruder or, in the case of surface-active agents having a low decomposition point, in incorporating it using a side extruder.

The amount of moisture in the web must be controlled after the surfactant treatment and, if necessary, the web must be dried. As the first step in the degradation of a PLA-based polymer is hydrolysis, it is necessary to prevent hydrolysis-induced degradation from starting at the packaging stage in the case of a nonwoven having a degree of moisture.

The degradation of a PLA-based hydrophilic disposable nonwoven will start more rapidly than that of an untreated nonwoven because it will be impregnated with water more easily and consequently the hydrolysis will start immediately. The properties of the nonwovens thus obtained are highly advantageous, in contrast to polyolefins, all the surfactants enabling nonwovens to be obtained which exhibit characteristics of being permanently hydrophilic.

Two examples of nonwovens according to the invention whose hydrophilic properties have been tested are described hereinbelow.

EXAMPLE 1

A nonwoven composed of continuous filaments, manufactured according to the S-tex process, having a weight of 20 g/m$^2$ and filaments of 2.1 dtex, is used as the surface layer for a diaper. The urine strike-through values (EDANA-150.1-90 test) lie between 10 and 15 s, the urine rewet being approximately 0.6 g (EDANA 151.1-92). After applying a 15% Silwet® 7602 solution, the urine strike-through lies between 2.5 and 3 s and the urine rewet between 0.8 and 1.0 g. After three repetitive tests, the run-off values are less than 1%. These results are remarkable. Using polypropylene nonwovens, the values are, after two tests, 25 s, 2.0 g and 100% respectively.

EXAMPLE 2

A nonwoven composed of continuous filaments manufactured according to the S-tex process, having a weight of 19 g/m$^2$ and filaments of 3.2 dtex, has a urine strike-through value of 11 s and a urine rewet of 0.7 g.

After treatment with foam using a 10% solution of Nuwet® 500, the treated web has values of 2.5 s in the case of urine strike-through, 4 g in the case of urine rewet and 3.5 s in the case of urine strike-through after three repetitive tests.

These results are superior to those obtained using an equivalent PP nonwoven, these being 5 s and 4 g respectively.

I claim:

1. A nonwoven web comprising thermoplastic fibers consisting essentially of polymer derived from lactic acid, said nonwoven web being treated with a polyether silicone copolymer, thereby making the web permanently hydrophilic.

2. The nonwoven as claimed in claim 1 in which the fibers are continuous filaments.

3. The nonwoven as claimed in claim 2, wherein the filaments have a diameter of between 0.1 and 100 $\mu$m.

4. The nonwoven as claimed in claim 1, which furthermore contains at least one of the following constituents: 0.1% to 15% of plasticizer, 0.1% to 5% of monomer, 0.01% to 5% of stabilizers, and pigments.

5. A process for obtaining a nonwoven web of claim 1, wherein said fibers are obtained from a spin bonding or meltblowing process.

6. The process as claimed in claim 5, wherein the fibers are obtained by extrusion at a temperature of between 140° C. and 280° C., passage through a spinneret whose holes have a diameter between 0.2 and 2 mm. cooling at a rate of 0.1 to 5 m/s and drawing between 10 and 4000 m/s.

7. The process as claimed in claim 5, wherein the permanent hydrophilic nature of the fibers is achieved by treatment with the surface-active agent using a process chosen from the group: lick-up, spraying, application of a foam, and injection.

8. The process as claimed in claim 7, wherein the surfactant in the lick-up process is dissolved in water at a concentration of 5% to 25%.

9. The nonwoven web of claim 1 wherein the polymer is selected from the group consisting of poly(L-lactic acid), poly(D-lactic acid), poly(DL-lactic acid) and a blend of at least two of these.

10. The nonwoven web of claim 9 wherein the polymer is poly(D-lactic acid).

11. The nonwoven web of claim 9 wherein the polymer is poly(L-lactic acid).

12. The nonwoven web of claim 9 wherein the polymer is poly(DL-lactic acid).

13. The nonwoven web of claim 9 wherein the polymer is a blend of at least two polymers selected from the group consisting of poly(D-lactic acid), poly(L-lactic acid) and poly(DL-lactic acid).

14. The nonwoven web of claim 1 which exhibits an initial urine strike-through value of less than about 3 seconds.

15. The nonwoven web of claim 1 wherein the nonwoven exhibits a urine strike-through value after three repetitive tests of less than about 3.5 seconds.

16. The nonwoven web of claim 14 which exhibits a urine rewet value at least about 33% of the urine rewet value of a comparison web of fibers consisting essentially of poly (lactic acid polymers), said comparison web being made free of surface-active agent.

17. The nonwoven web of claim 16 which exhibits a urine rewet value of about 33% to about 470% of the urine rewet value of said comparison web.

18. The nonwoven web of claim 1 which is a spunbond web.

19. The nonwoven web of claim 1 which is a meltblown web.

* * * * *